US008553891B2

(12) United States Patent
Szczerba et al.

(10) Patent No.: US 8,553,891 B2
(45) Date of Patent: Oct. 8, 2013

(54) LOW COMPLEXITY PARAMETRIC STEREO DECODER

(75) Inventors: Marek Zbigniew Szczerba, Eindhoven (NL); Erik Gosuinus Petrus Schuijers, Eindhoven (NL); Paulus Henricus Antonius Dillen, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1098 days.

(21) Appl. No.: 12/525,772

(22) PCT Filed: Feb. 4, 2008

(86) PCT No.: PCT/IB2008/050401

§ 371 (c)(1),
(2), (4) Date: Aug. 4, 2009

(87) PCT Pub. No.: WO2008/096313

PCT Pub. Date: Aug. 14, 2008

(65) Prior Publication Data

US 2010/0023335 A1 Jan. 28, 2010

(30) Foreign Application Priority Data

Feb. 6, 2007 (EP) ..... 07101766

(51) Int. Cl.
*H04R 5/00* (2006.01)

(52) U.S. Cl.
USPC ..... 381/1; 704/E19.001

(58) Field of Classification Search
USPC ..... 381/1–23, 300–311; 700/94; 704/E19.001–E19.005, 500
See application file for complete search history.

(56) References Cited

U.S. PATENT DOCUMENTS 6,298,322 B1 10/2001 Lindemann
7,116,787 B2 10/2006 Faller (Continued)

FOREIGN PATENT DOCUMENTS

WO 03090208 A1 10/2003
WO 2006005244 A1 1/2006

(Continued)

OTHER PUBLICATIONS

McAuley et al: "Computationally Efficient Sine-Wave Synthesis and Its Application to Sinusoidal Transform Coding"; IEEE 1998, pp. 370-373.

(Continued)

*Primary Examiner* — Vivian Chin
*Assistant Examiner* — Fatimat O Olaniran

(57) ABSTRACT

A stereo audio decoder generates a set of stereo output channels in response to a parametric audio input including signal parameters and stereo related parameters. A parameter processor generates two different set of parameters based on the input signal parameters thus up-mixing the signal parameters by altering or manipulating the signal parameters corresponding to the stereo related parameters. The two different parameters are synthesized by separate signal synthesizers to form respective stereo output channels. The signal synthesizers may be sinusoidal synthesizers, and the decoder also includes transient and noise synthesizers to generate transient and noise signal portions to be applied to the stereo output channels. Further, different transient and noise signal portions to the output channels may be provided by applying different gains based on the stereo related parameter. The two different parameters may be determined from current and previous signal parameter inputs using an input delay line.

20 Claims, 4 Drawing Sheets

(56) References Cited

U.S. PATENT DOCUMENTS

| | | | | |
|---|---|---|---|---|
| 7,146,324 | B2 * | 12/2006 | Den Brinker et al. | 704/500 |
| 7,447,629 | B2 * | 11/2008 | Breebaart | 704/219 |
| 7,542,896 | B2 * | 6/2009 | Schuijers et al. | 704/201 |
| 7,734,473 | B2 * | 6/2010 | Schuijers et al. | 704/503 |
| 8,015,018 | B2 * | 9/2011 | Seefeldt et al. | 704/501 |
| 8,135,136 | B2 * | 3/2012 | Van Loon et al. | 381/1 |

FOREIGN PATENT DOCUMENTS

| | | | |
|---|---|---|---|
| WO | 2006048226 | A1 | 5/2006 |
| WO | 2006060280 | A2 | 6/2006 |
| WO | 2006085243 | A2 | 8/2006 |
| WO | 2007004186 | A2 | 1/2007 |
| WO | WO 2007004186 | A2 * | 1/2007 |

OTHER PUBLICATIONS

Purnhagen, H."Low Complexity Parametric Stereo Coding in MPEG-4"; Proceedings of the 7th International Conference on Digital Audio Effects (DAFx'04), Naples, Italy, Oct. 5-8, 2004, pp. 163-168.

Schuijers et al: "Low Complexity Parametric Stereo Coding"; Audio Engineering Society Convention Paper 6073, Presented at the 116th Convention in Berlin, Germany, May 8-11, 2004, pp. 1-11.

Schuijers et al: "Advances in Parametric Coding for High-Quality Audio"; Audio Engineering Society Convention Paper 5852, Presented at the 114th Convention in Amsterdam, The Netherlands, Mar. 22-25, 2003, pp. 1-11.

ISO/IEC 14496-3:2001/AMD2:"Information Technology-Coding of Audio-Visual Objects—Part 3: Audio, Amendment 2: Parametric Audio Coding", ISO/IEC JTC1/SC29/WG11/N6130, Dec. 2003, 133 Page Document.

Breebaart et al:"High-Quality Parametric Spatial Audio Coding at Low Bitrates"; Audio Engineering Society Convention Paper 6072, Presented at the 116th Convention in Berlin, Germany, May 8-11, 2004, pp. 1-13.

* cited by examiner

LOW COMPLEXITY PARAMETRIC STEREO DECODER

FIELD OF THE INVENTION

The invention relates to the field of audio coding. More specifically, the invention relates to stereo audio coding, in particular the invention provides an audio decoder arranged to decode a parameterized audio signal into a stereo audio signal and a device including such decoder. The invention also provides a decoding method and computer executable program code arranged to perform such method.

BACKGROUND OF THE INVENTION

Sinusoidal Coding (SSC) is a well-known parametric coding scheme that is capable of full bandwidth high quality audio coding, see e.g. [ISO/IEC 14496-3:2001/AMD2, "Information Technology—Generic Coding of Audiovisual Objects. Part 3: Audio. Amendment 2: High Quality Parametric Audio Coding"] and [Werner Oomen, Erik Schuijers, Bert den Brinker, Jeroen Breebaart, "Advances in Parametric Coding for High-Quality Audio", 114th AES Convention, Amsterdam, The Netherlands, Mar. 22-25 2003, preprint 5852]. Such SSC coding scheme dissects a monaural or stereo audio signal into a number of objects that each can be parameterized and efficiently encoded at a low bit-rate. These three objects are: transients (representing dynamic changes in the temporal domain), sinusoids (representing deterministic components), and noise (representing components that do not have a clear temporal or spectral localization). In case of stereo audio signals, a fourth set of parameters is relevant, namely a set of spatial image parameter that describe a relation between the two stereo channels.

Normally, at a decoder side, such parametric stereo representation of an audio signal is decoded in the spectral domain, see e.g. [Jeroen Breebaart, Steven van de Par, Armin Kohlrausch, Erik Schuijers, "High-Quality Parametric Spatial Audio Coding at Low Bitrates", 116th AES Convention, Berlin, Germany, May 8-11 2004, preprint 6072]. Most often the spectral domain stereo representation involves computing processes such as Fast Fourier Transform (FFT) or transformation to the Quadrature Mirror Filter (QMF) domain, see e.g. [Erik Schuijers, Jeroen Breebaart, Heiko Purnhagen, Jonas Engdegård, "Low Complexity Parametric Stereo Coding", 116th AES Convention, Berlin, Germany, May 8-11 2004, preprint 6073]. In order to reduce SSC decoder complexity, the sinusoidal components can be synthesized directly in the spectral domain. However, only sinusoidal components can be efficiently synthesized in the spectral domain. Transforming the other components to the spectral domain, i.e. transients and noise, requires a substantial computational effort.

It is also known to only transform the time signal which is the sum of the sinusoidal components to the spectral domain, and then perform the stereo decorrelation process in the spectral domain on the sinusoidal part only. The stereo spectral domain representations resulting from this process are then applied to separate synthesis filter banks for each channel to arrive at time domain stereo sinusoidal parts. Finally, the noise and transient components are added to the stereo sinusoidal parts in the time domain. However, such solution has the perceptual disadvantage that the noise and transient sounds appear to "stand out" in the sound image, and still the stereo decorrelation process in the spectral domain is a complex process that requires a substantial amount of computations.

In conclusion, known stereo decoding methods are not suited for devices where a limited signal processing capacity is available, e.g. mobile and miniature devices.

SUMMARY OF THE INVENTION

According to the above, it may be seen as an objective to provide an audio decoder capable of decoding a stereo, i.e. two channel, audio signal with a low complexity to reduce the required computing power to perform the decoding.

This object is achieved by a first aspect of the invention by providing an audio decoder for generating first and second audio channels in response to a parametric audio representation including at least a set of signal parameters and a spatial image parameter, the decoder comprising:

- a parameter processing unit arranged to generate a first and a second set of parameters based on the set of signal parameters, wherein the parameter processing unit is arranged to generate a difference between the first and second sets of parameters based on the spatial image parameter,
- a first signal synthesizer arranged to generate a first audio channel according to the first set of parameters, and
- a second signal synthesizer arranged to generate a second audio channel according to the second set of parameters.

Thus, according to the first aspect, computational complexity is reduced by providing independent signal synthesizer or generator, preferably independent sinusoidal synthesizers, for the individual stereo channels, where these signal synthesizers are provided with separate first and second sets of signal parameters from the parameter processing unit, where these first and second sets of signal parameters have been prepared preferably in the parameter domain, i.e. by manipulating or altering one or more components in the input set of signal parameter in order to produce first and second set of signal parameters that correspond to the stereo information in the input spatial image data. Hereby, it is possible to provide decoder embodiments with very low complexity since only simple parameter manipulations are required in the up-mixing since this can be performed without involving computationally complex spectral domain transformations such as required in the prior art.

The first and second signal synthesizers are preferably the same type of synthesizers, e.g. identical type of synthesizers and preferably identical synthesizers.

The first and second signal synthesizers may include sinusoidal, transient type or noise type synthesizers. However, preferably, the parameter processing unit is arranged to generate first and second sets of sinusoidal parameters that are applied to first and second, preferably identical, signal synthesizers. In a basic decoder embodiment the first and second signal synthesizers are respective identical sinusoidal synthesizers taking sets of frequency, amplitudes and phases as in parameters.

The parameter processing unit may generate the difference between the first and second sets of parameters based on at least one of: an inter-channel correlation parameter, an inter-channel intensity difference parameter, an inter-channel phase, and an inter-channel time difference parameter, preferably two or more of these parameters are taken into account in performing an up-mixing of the set of signal parameters.

In embodiments where the first and second signal synthesizers include respective first and second sinusoidal synthesizers, the parameter processing unit may be arranged to generate first and second sets of sinusoidal parameters, wherein at least one sinusoidal component, preferably more, of the two sets of sinusoidal parameters differs with respect to at least one of, preferably more of: amplitude, frequency and phase.

The decoder may include a value generator including at least one of: a low frequency oscillator and a random number generator. The parameter processing unit utilizes this value generator to introduce a difference between the first and second sets of parameters based on a value received from the value generator.

The decoder preferably includes a delay unit arranged to generate a delayed version of at least one signal parameter of the set of signal parameters. The parameter processing unit then generates the first and second set of parameters based on the at least one signal parameter of the set of signal parameters as well as the delayed version of the at least one signal parameter. Preferably, this is done in the following manner: the parameter processing unit performs a first up-mixing based on the at least one signal parameter of the set of signal parameters to form a first intermediate stereo set of parameters. Next, a second up-mixing is performed based on the delayed version of the at least one signal parameter to form a second intermediate set of stereo parameters. Finally, the first and second intermediate sets of stereo parameters are combined to form the first and second set of parameters. The delay unit may be arranged to provide a variable delay, e.g. the variable delay is a function of at least one parameter component in one of the first and second set of parameters.

The parameter processing unit may be arranged to alter, e.g. scale, at least one of: amplitude, frequency and phase, of at least one sinusoidal component of one of the first and second set of parameters, according to the spatial image parameter. The parameter processing unit may be arranged to apply at least one of: a gain to an amplitude, a shift to a phase, and a shift to a frequency, of a sinusoidal component of the first and second set of parameters.

Decoder embodiments based on separate sinusoidal synthesizers for each stereo channel may further include a noise synthesizer and/or a transient synthesizer arranged to generate respective noise and transient signals based on respective noise and transient parameters in the parametric audio representation, and wherein the noise and transient signals are applied to the first and second audio channels. Preferably, the noise and transient signals are combined with outputs of the first and second sinusoidal synthesizers in the temporal domain.

Decoder embodiments including a transient synthesizer may further include a gain calculation unit arranged to apply different gains to the transient signal so as to generate different first and second transient signal portions to be applied to the respective first and second audio channels. Likewise, decoder embodiments with a noise synthesizer may further include a gain calculation unit arranged to apply different gains to the noise signal so as to generate different first and second noise signal portions to be applied to the respective first and second audio channels.

Embodiments with a noise synthesizer may further include a second noise synthesizer arranged to generate a second noise signal based on the noise parameter in the parametric audio representation. This second noise synthesizer is then arranged to generate a noise signal essentially uncorrelated with the noise signal generated by the first noise synthesizer, and the first and second noise signals are mixed to form first and second noise signal portions to be applied to the respective first and second audio channels.

Embodiments with a noise synthesizer may further include a low-frequent noise generator arranged to generate low-frequent noise. This low-frequent noise is then multiplied with the noise signal generated by the noise synthesizer to generate a second noise signal essentially uncorrelated with the first noise signal generated by the noise synthesizer, and the first and second noise signals are mixed to form first and second noise signal portions to be applied to the respective first and second audio channels.

Preferably, the decoder is arranged to update the first and second set of parameters for each frame of the input parametric audio representation.

In a second aspect, the invention provides a device including an audio decoder according to the first aspect. The device may be any type of electronic device including entertainment electronics such as audio-visual electronic equipment, and as mentioned the decoder is suitable also for mobile equipment. The decoder is suited for devices within or related to the fields of such as: parametric decoders, MPEG4 parametric audio, music synthesizers, mobile devices, ring tones, gaming devices, portable players (e.g. solid-state audio). It is appreciated that the same advantages and the same embodiments as mentioned for the first aspect apply as well for the second aspect.

In a third aspect, the invention provides a method of generating first and second audio channels in response to a parametric audio representation including at least a set of signal parameters and a spatial image parameter, the method comprising:

generating a first and a second set of parameters based on the set of signal parameters, wherein a difference between the first and second sets of parameters is generated based on the spatial image parameter, generating a first audio channel by synthesizing the first set of parameters, and generating a second audio channel by synthesizing the second set of parameters.

It is appreciated that the same advantages and the same embodiments as mentioned for the first aspect apply as well for the third aspect.

In a fourth aspect, the invention provides a computer executable program code adapted to perform the method according to the third aspect. Such program code can in principle be executed on dedicated signal processors or general computing hardware. It is appreciated that the same advantages and the same embodiments as mentioned for the first aspect apply as well for the third aspect.

In a fifth aspect, the invention provides a data carrier, or computer readable storage medium, comprising a computer executable program code according to the fourth aspect. A non-exhaustive list of storage media is: memory stick, a memory card, it may be disk-based e.g. a CD, a DVD or a Blue-ray based disk, or a hard disk e.g. a portable hard disk. It is appreciated that the same advantages and the same embodiments as mentioned for the first aspect apply as well for the fifth aspect.

It is appreciated that any one sub aspect mentioned for the first aspect may each be combined with any of the other aspects.

BRIEF DESCRIPTION OF THE FIGURES

The present invention will now be explained, by way of example only, with reference to the accompanying Figures, where.

DETAILED DESCRIPTION OF EMBODIMENTS

In the following, five decoder embodiments will be described referring to the signal block diagrams of illustrated in FIGS. 1-5. In all Figures, the decoder is indicated by a dashed box.

Figure 1:
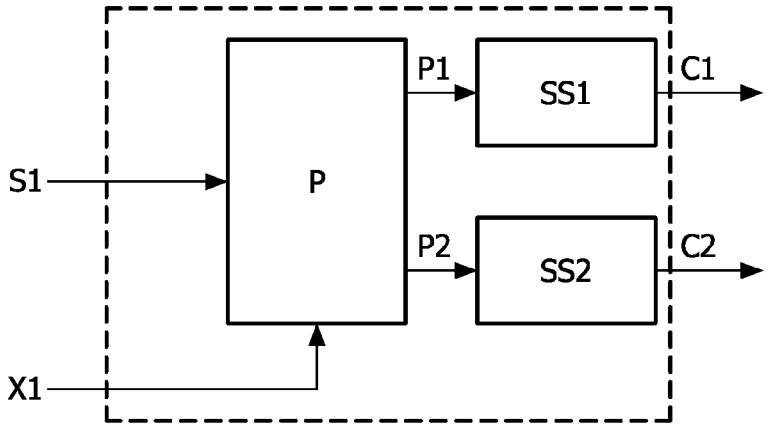
FIG. 1 illustrates a basic stereo audio decoder embodiment according to the invention.

FIG. 1 illustrates a basic stereo audio decoder embodiment to illustrate the principles of the invention. This decoder embodiment takes as input a stream of frames of parametric audio representations S1, X1 including for each frame a set of signal parameters S1 and at least one spatial image parameter X1. Especially, the signal parameters S1 includes a representation of a set of sinusoidal components including for each component e.g. values describing frequency, amplitude and phase, or at least the signal parameters S1 include a representation where such values can be derived. The spatial image parameters X1 may include one or more of: 1) an inter-channel cross-correlation (ICC) parameter describing cross-correlation or coherence between the stereo channels, 2) an inter-channel intensity difference (IID) parameter describing intensity difference between the stereo channels, 3) an inter-channel phase difference (IPD) or time difference parameter, and 4) an overall phase difference (OPD) parameter describing how the phase difference is distributed between the stereo channels, see e.g. [Heiko Purnhagen, "Low Complexity Parametric Stereo Coding in MPEG-4", Proc. Of the 7th International Conference on Digital Audio Effects (DAFx'04), Naples, Italy, Oct. 5-8, 2004].

The sinusoidal parameters S1 and the spatial image parameters X1 are applied to a parameter processing unit P that utilizes the spatial image parameters X1 to form an up-mixing of the mono sinusoidal parameter data S1 to two separate sets of sinusoidal parameters P1 and P2 that are applied to separate sinusoidal synthesizers SS1, SS2. These sinusoidal synthesizers SS1, SS2 generate separate audio frames according to the separate sets of parameters P1, P2, and these separate audio frames form respective first and second audio channels C1, C2.

The up-mixing process in the parameter processing unit P can be performed such as known in the art. However, it is preferred that the parameter processing unit P performs the up-mixing directly on the mono set of sinusoidal parameters by applying the spatial image parameters X1 to arrive at the stereo set of sinusoidal parameters P1, P2. In essence, the sets of sinusoidal parameters P1 and P2 can be generated from copies of the input sinusoidal parameters where the channel differences is obtained by altering or manipulating one or more of amplitude, frequency and phase for one or more sinusoidal component according to the spatial image parameter X1. This alteration or manipulation can be performed on the parameter for one channel only or for both channels.

Thus, according to the above, stereo synthesis is performed with simple processing of the input parameters, and a computationally demanding spectral domain transformation can be avoided. Thus, such stereo audio decoder is suited for application in mobile and miniature devices.

To illustrate a specific up-mixing process according to prior art based on spatial image parameter X1 including IIC and IID values, as described above. These IIC and IID values may be specified per frequency band, where the frequency scale is psycho-acoustically relevant, i.e. Bark or ERB like frequency scale.

A stereo signal $[\hat{L}_{k,i}, \hat{R}_{k,i}]$ can then be reconstructed according to:

$$\begin{bmatrix} \hat{L}_{k,i} \\ \hat{R}_{k,i} \end{bmatrix} = H_{k,i} \begin{bmatrix} M_{k,i} \\ D_{k,i} \end{bmatrix}, \text{ where} \tag{1}$$

$$H = \begin{bmatrix} c_L\cos(\beta+\alpha) & c_L\sin(\beta+\alpha) \\ c_R\cos(\beta-\alpha) & c_R\sin(\beta-\alpha) \end{bmatrix} \tag{2}$$

is an up-mix matrix, where $$c = 10^{\frac{IID}{20}},\ c_L = \frac{\sqrt{2}\,c}{\sqrt{1+c^2}},\ c_R = \frac{\sqrt{2}}{\sqrt{1+c^2}}, \text{ and} \tag{3}$$

$$\alpha = \frac{\arccos(ICC)}{2}, \text{ and} \tag{4}$$

$$\beta = \arctan\left(\tan(\alpha)\frac{c_R - c_L}{c_R + c_L}\right) \tag{5}$$

which can be approximated as:

$$\beta = \alpha\frac{c_R - c_L}{\sqrt{2}}. \tag{6}$$

M is the decoded mono signal and D its decorrelated version. The decorrelated signal is preferably generated by means of an appropriate all-pass filter and preferably has similar spectral and temporal energy distribution as the decoded mono signal.

Preferably, the decoder takes one input frame of S1, X1 and outputs in response corresponding output channels C1, C2 representing the input frame.

Figure 2:
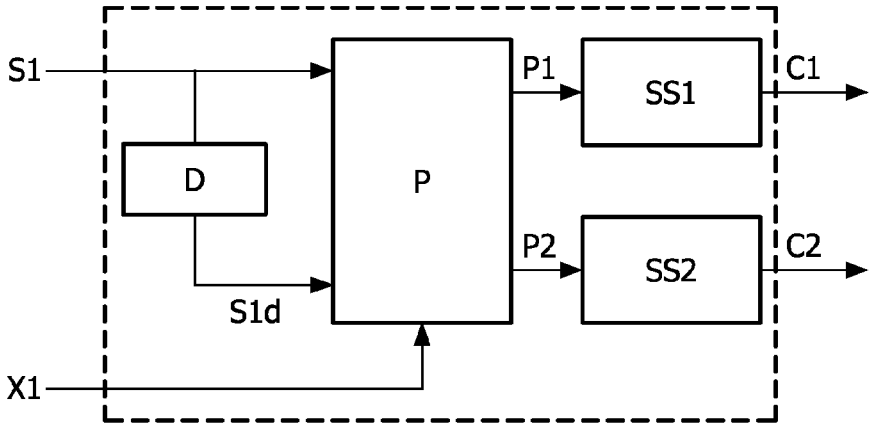
FIG. 2 illustrates another basic stereo audio decoder embodiment.

FIG. 2 illustrates an extended version of the basic decoder described above referring to FIG. 1. The decoder of FIG. 2 includes a delay unit D that receives the signal parameter representation S1, i.e. including a set of sinusoidal parameters. This signal parameter representation S1 is applied to a parameter processing unit P, such as described above for FIG. 1. However, the delay unit D applies an additional delayed version of the signal parameter representation S1 to the parameter processing unit P. Thus, at a certain time, both the current sinusoidal parameters S1 are available together with a delayed version of the sinusoidal parameters S1*d* corresponding to the input parameters at a previous time, e.g. parameters corresponding to the previous frame. Based on the spatial image parameters X1, the parameter processing unit P manipulates, at one time, both set of sinusoidal parameters S1 and S1*d* to arrive at a total of four sets of sinusoidal parameters, i.e. two separate sets of stereo sinusoidal parameters both based on the same spatial image parameters X1. Thus, for each channel, there are two sets of parameters available.

These two sets of sinusoidal parameters for the respective stereo channels are then combined to form first and second sets of parameters P1, P2 for synthesis in respective sinusoidal synthesizers SS1, SS2 that generate signals for the respective output channels C1, C2.

FIGS. 3-6 illustrate four different stereo audio decoder embodiments arranged to take as input a parametric audio representation where the sets of signal parameters includes sinusoidal parameters S1, a transient parameter T1, a noise parameter N1 that are synthesized independently by separate sinusoidal synthesizers SS1, SS2 for each of the two output channels C1, C2, a transient synthesizer TS, one or two noise synthesizers NS, NS1, NS2, and a low-frequent noise generator LFN. The transient parameter T1 preferably includes components represented by temporal envelope and underlying periodic parameters. The periodic parameters for transients are typically sinusoidal parameters, i.e. frequency amplitude and phase. The noise parameter N1 preferably includes components represented by spectral and temporal envelopes.

Outputs from the two sinusoidal synthesizers SS1, SS2, the transient synthesizer TS, noise synthesizers NS, NS1, NS2, and low-frequent noise generator LFN are then finally combined to form the two audio channels C1, C2. Further, the three decoders all take as input one or more spatial image parameters X1 as also described above, and in all four embodiments, the decoders include a gain calculation unit GC arranged to receive the spatial image parameter X1 and to output a set of gains accordingly. The more detailed function of the gain calculation unit GC will be described for each embodiment. In one embodiment the parameter processing unit P is directly indicated, while in two embodiments this unit is split into a delay unit D and an up-mixing matrix M.

Finally, in all of FIGS. 3-6 a '+' indicates a summation unit of summation point, while 'x' indicates a multiplier or multiplication point.

Figure 3:
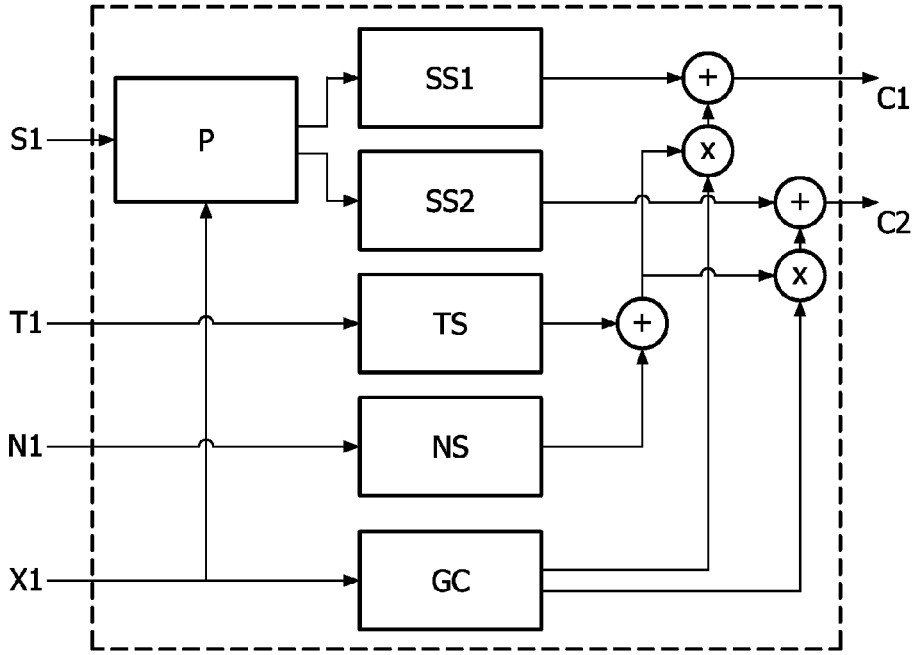
FIG. 3 illustrates a stereo audio decoder embodiment arranged to decode a parametric signal with both sinusoidal, transient and noise components.

FIG. 3 illustrates an embodiment including the same components P, SS1, SS2 with the same function as described for FIG. 1. A mono transient signal and a mono noise signal generated by the respective transient and noise synthesizers TS, NS are distributed between the two output channels C1, C2 with respect to the gain parameters derived in the gain calculator unit GC from the spatial image parameter X1. Separate gain values can be used for noise and transients respectively, however for further simplification, the same gain can be used for both noise and transients. In the illustrated embodiment, the noise and transient signals are summed to a combined noise and transient signal before being applied with the gains for each channels, thus the same gains are applied to the noise and transient signal portions. Preferably, the noise synthesizer NS employs a frequency-warped (Laguerre) filter.

Alternatively, it is possible to distribute the transient components with respect to their frequencies and appropriate IID and/or ICC values in particular frequency bands as will be described for the sinusoidal components below.

In the embodiment of FIG. 3 the parameter processing unit P includes altering the original frequency, amplitude and phase parameters of the sinusoidal component in the input set of parameters S1 with respect to the stereo parameters. In particular, it is preferred that the sinusoidal parameters of a component are altered with respect to the incoming stereo parameters associated with a particular frequency band the sinusoidal component belongs to. More specifically, it is proposed that 1) an amplitude of a sinusoidal component is altered with respect to an IID parameter, 2) a frequency of a sinusoidal component is altered with respect to an ICC parameter value and/or a current value of a low-frequency oscillator (LFO) built in the decoder, and 3) a phase of a sinusoidal component is altered with respect to an ICC parameter, frequency of a sinusoidal component and a current value of the low-frequency oscillator (LFO) built in the decoder.

In the embodiment of FIG. 3, the decorrelated signal D (referring to equations (1)-(6)) is simulated by combining an appropriate phase and frequency shift with the low-frequency oscillator. However, it is also possible to use an embodiment without the low-frequency oscillator, where a phase of a sinusoidal component is altered with respect to an ICC parameter value and component frequency. A random number generator might be also used as a supplement or replacement of the low-frequency oscillator unit.

In order to accurately reproduce the transmitted ICC values using phase adjustments for frequencies below approximately 2 kHz, it is important that the overall (weighted) average phase rotation within the perceptually relevant (ERB) band is substantially close to zero as otherwise effectively IPD cues are synthesized leading to a different spatial image. For the lowest perceptually relevant bands, this is however difficult to accomplish as the bandwidths for these bands typically allows for only a few sinusoidal components to be present. Therefore, in an alternative embodiment, for the components located at very low frequencies only small frequency adjustments are made to ensure proper decorrelation between the two stereo channels, whereas for the components located at high frequencies only phase adjustments are made.

Figure 4:
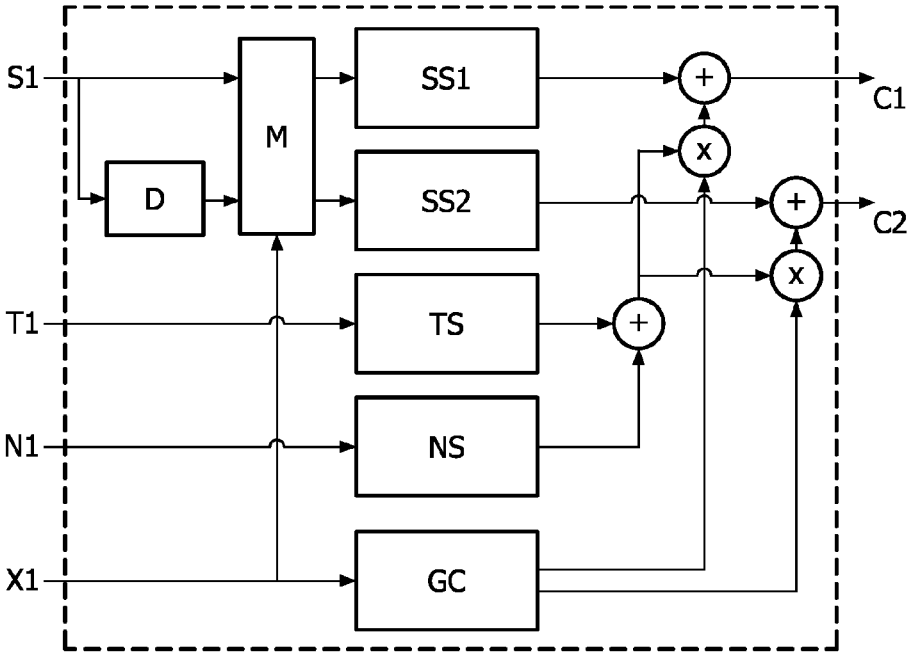
FIG. 4 illustrates another stereo audio decoder embodiment arranged to decode a parametric signal with both sinusoidal, transient and noise components.

FIG. 4 illustrates another stereo audio decoder embodiment where stereo decorrelation is performed by using sinusoidal parameters from past (sub-)frames, by introducing a delay unit D to provide a delayed version of the set of sinusoidal input parameters S1 to an up-mixing unit M, i.e. in a manner similar to that described in connection with the embodiment of FIG. 2. With respect to distributing noise and transient signal components from the noise and transient synthesizers NS, TS to the output channels C1, C2, by means of a gain calculator unit GC, the function as described for FIG. 3 applies to the embodiment of FIG. 4.

Preferably the delay unit D includes a delay line used to provide the up-mixing unit M with sinusoidal parameters of the past. The length of the delay line can be fixed or variable. In particular, the delay time can be a function of sinusoidal component frequency. The original frequency, amplitude and phase parameters of the sinusoidal component are used in order to form the decorrelated component. Sinusoidal parameters for both mono and delayed mono signals are provided to the parameter up-mixing unit M. The up-mixing unit M scales the amplitudes of the original and delayed sinusoidal components according to the spatial image parameters X1 provided. The following rules may be implemented 1) The amplitude of an original sinusoidal component is altered for one of the output channels C1, C2 with respect to the value of the IID (and ICC) parameter relevant to the frequency of the particular component, 2) the amplitudes of a delayed sinusoidal component are altered for both of the output channels with respect to the values of the IID and ICC parameter relevant to the frequency of the particular component, and 3) the phase of the delayed sinusoidal component for one of the output channels is inverted (i.e. altered by 180 degrees).

More specifically, the amplitudes of delayed sinusoidal components can be altered with respect to the ICC parameters only, regardless of the IID parameter values.

The preferred solution, based on a fixed-length delay, does not provide all-pass decorrelation filter characteristics. Such characteristics, if applied to the signals characterized by the continuous spectrum, would result in signal coloring. However, since the fixed-length delay is applied only to the stationary sinusoidal components, the coloring effect has no negative effect on the signal quality.

Figure 5:
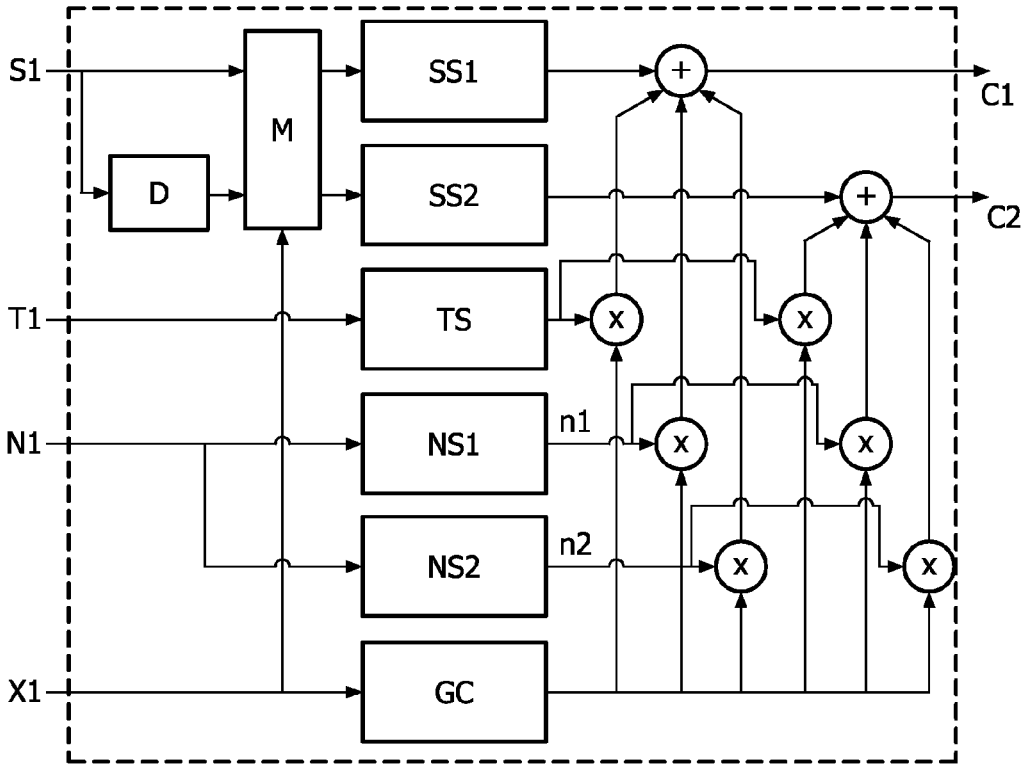
FIG. 5 illustrates yet another stereo audio decoder embodiment arranged to decode a parametric signal with both sinusoidal, transient and noise components.

FIG. 5 illustrates yet another stereo audio decoder embodiment, being an extended version of the one from FIG. 4, and thus the above explanation applies for the embodiment of FIG. 5 as well.

The extension is that a more advanced noise synthesis is included in the embodiment of FIG. 5 in order to provide an even better stereo imaging. As seen, two noise synthesizers NS1, NS2 are included, and both noise synthesizers NS1, NS2 receive the same input noise parameters N1. However, the noise synthesizers NS1, NS2 differ only in the aspect that their internally generated source signals are uncorrelated, typically created by means of independent random generators starting at different seeds. The subsequent processing (temporal envelope, Laguerre frequency noise shaping) in both synthesizers NS1, NS2 is identical and thus they generate respective first and second uncorrelated noise signals n1, n2. Though both noise synthesizers NS1, NS2 are essentially the same in operation, one noise synthesizer NS1 output noise signal n1 serves as the 'mono' noise, while the output noise signal n2 from the other noise synthesizer NS2 serves as a 'decorrelated' noise for the stereo up-mixing.

In this embodiment, the gain calculation unit GC computes (from the parametric spatial image parameters X1) individual panning gains for the transient signal and for either of the both noise synthesizer output signals n1, n2. These panning gains are applied before summing mentioned signals to the two output channels C1, C2. Thus, as seen in FIG. 5, the two noise signals n1, n2 both contribute to both output signals C1, C2.

The panning gains for the transient signal from the transient synthesizer TS are typically computed by substituting in equations (2) through (6): 1) for IID, the (unweighted or weighted) mean of the individual IID values over the parametric stereo bands, and 2) for ICC, the value '1' (implying fully correlated transient signal always). This means that $\alpha=\beta=0$, and matrix H degrades to:

$$H = \begin{bmatrix} c_L & 0 \\ c_R & 0 \end{bmatrix} \tag{7}$$

Therefore, the transient panning gains equal $c_L$ and $c_R$ respectively.

The gains for the 'mono' and 'decorrelated' noise signals n1, n2 from the noise synthesizers NS1, NS2 are typically computed by substituting in equations (2) through (6): 1) for IID, the (unweighted or weighted) mean of the individual IID values over the parametric stereo bands, and 2) for ICC, the (unweighted or weighted) mean of the individual ICC values over the parametric stereo bands. Thus, the gain factors are defined by the resulting matrix H, and the stereo noise contribution becomes:

$$\begin{bmatrix} \hat{L}_{noise} \\ \hat{R}_{noise} \end{bmatrix} = H \begin{bmatrix} M_{noise} \\ D_{noise} \end{bmatrix} \tag{8}$$

where $M_{noise}$ and $D_{noise}$ equal the 'mono' and 'decorrelated' noise synthesizer output signals n1, n2, respectively.

In the embodiment of FIG. 5, panning gains for the transient and noise signals n1, n2 are preferably different.

Figure 6:
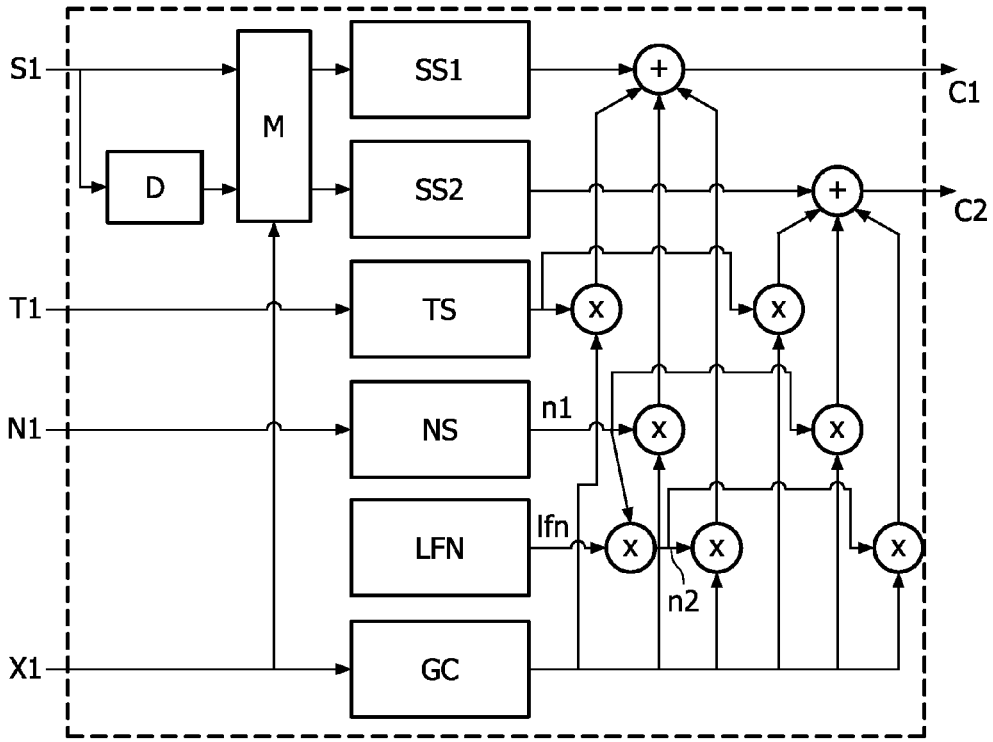
FIG. 6 illustrates still another stereo audio decoder embodiment arranged to decode a parametric signal with both sinusoidal, transient and noise components.

Note that for illustration simplicity reasons, gains from the gain calculation units GC on FIGS. 5 and 6 are indicated by a single output line from box GC. However, it is appreciated that the gain calculation units GC of FIGS. 5 and 6 may generate different gains to all multiplying points, or some of or even all of the gains may have the same value.

FIG. 6 illustrates still another stereo audio decoder embodiment, being a variation of the one from FIG. 5, and thus the above explanation mostly applies for the embodiment of FIG. 6 as well. The variation in FIG. 6 is that a more efficient noise synthesis is included in the embodiment in order to provide lower decoder complexity. As seen in FIG. 6, a noise synthesizers NS and a low-frequent noise generator LFN are included. Only the noise synthesizer NS receives the input noise parameters N1. The noise signal n1 generated by noise synthesizer NS is subsequently multiplied by the low-frequent noise signal lfn produced by the low-frequent noise generator so as to create a second noise signal n2 which is essentially uncorrelated to the first noise signal n1, but which approximates noise signal n1 in terms of spectral shape and temporal envelope. Again, noise signal n1 serves as the 'mono' noise, while noise signal n2 serves as a 'decorrelated' noise for the stereo up-mixing. Since a low-frequent noise generator is typically less computationally complex than the processing required (temporal envelope, Laguerre frequency noise shaping) in a single noise synthesizer, this variation leads to a reduction of complexity.

Figure 7:
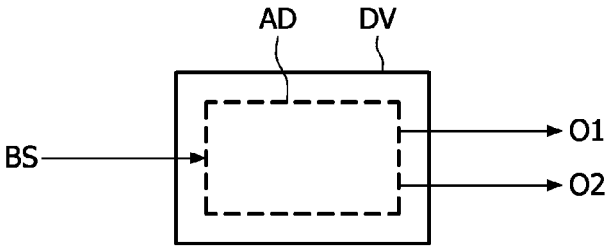
FIG. 7 illustrates a device for receiving a digital bit stream representing a parametric audio signal and to decode this signal into two audio channels.

FIG. 7 illustrates a device DV, e.g. a mobile or miniature device such as a mobile DVD or MP3 player, or a mobile phone or game device. The device DV is arranged to receive a digital bit steam BS including a coded stereo audio signal in a parametric representation. This parametric representation is provided to a stereo audio decoder AD according to the invention, and thereby according to the above description. In some embodiments the stereo audio decoder AD is arranged to provide a digital stereo PCM output signal, and this output signal is then applied to a digital to analog converter that outputs an analog stereo signal which is amplified by an amplifier and thus resulting in a set of two output channels O1, O2, that can be applied to a set of stereo headphones or stereo loudspeakers.

To sum up the invention: a stereo audio decoder with low complexity is provided. A high stereo sound quality can be obtained with a limited computational power and is thus suitable for miniature and mobile equipment. The stereo decoder generates a set of stereo output channels (C1, C2) in response to a parametric audio input including signal parameters (S1) and stereo related parameters (X1). A parameter processor (M) generates two different set of parameters (P1, P2) based on the input signal parameters (S1) thus up-mixing the signal parameters (S1) by altering or manipulating the signal parameters (S1) corresponding to the stereo related parameters (X1). The two different parameters (P1, P2) are finally synthesized by separate signal synthesizers (SS1, SS2) to form respective stereo output channels (C1, C2). Since the stereo decoding can be performed in the parameter domain instead of the spectral domain, the required computational burden is reduced compared to what is known in prior art. Preferably the signal synthesizers (SS1, SS2) are sinusoidal synthesizers, and preferably the decoder also includes transient and noise synthesizers to generate transient and noise signal portions to be applied to the stereo output channels (C1, C2). Further, different transient and noise signal portions to the output channels (C1, C2) may be provided by applying different gains based on the stereo related parameter (X1). In preferred embodiments the two parameters (P1, P2) are determined from a current as well as a previous signal parameter input, e.g. by means of an input delay line.

Although the present invention has been described in connection with the specified embodiments, it is not intended to be limited to the specific form set forth herein. Rather, the scope of the present invention is limited only by the accompanying claims. In the claims, the term "comprising" does not exclude the presence of other elements or steps. Additionally, although individual features may be included in different claims, these may possibly be advantageously combined, and the inclusion in different claims does not imply that a combination of features is not feasible and/or advantageous. In addition, singular references do not exclude a plurality. Thus, references to "a", "an", "first", "second" etc. do not preclude a plurality. Furthermore, reference signs in the claims shall not be construed as limiting the scope.

The invention claimed is:

1. An audio decoder for generating a first audio output channel and a second audio output channel in response to a parametric audio representation including a set of signal parameters and a spatial image parameter, the decoder comprising:

a parameter processing unit configured to generate a first set of parameters and a second set of parameters based on the set of signal parameters, wherein the parameter processing unit is configured to generate a difference between the first sets of parameters and the second sets of parameters based on the spatial image parameter;

a first signal synthesizer configured to generate the first audio output channel according to the first set of parameters;

a second signal synthesizer configured to generate the second audio output channel according to the second set of parameters; and a delay unit configured to generate a delayed version of at least one signal parameter of the set of signal parameters, wherein the parameter processing unit generates the first set of parameters and the second set of parameters based on the at least one signal parameter of the set of signal parameters and the delayed version of the at least one signal parameter.

2. The audio decoder according to claim 1, wherein the first signal synthesizer and the second signal synthesizer are a same type of synthesizers.

3. The audio decoder according to claim 1, wherein the parameter processing unit generates the difference between the first set of parameters and the second set of parameters based on at least one of: an inter-channel correlation parameter, an inter-channel intensity difference parameter, an inter-channel phase, and an inter-channel time difference parameter.

4. The audio decoder according to claim 2, wherein the first set of parameters and the second set of parameters are two sets of sinusoidal parameters, and wherein the first signal synthesizer and the second signal synthesizer include respective first and second sinusoidal synthesizers.

5. The audio decoder according to claim 2, wherein the first set of parameters and the second set of parameters are two sets of sinusoidal parameters, and wherein at least one sinusoidal component of the two sets of sinusoidal parameters differs with respect to at least one of: amplitude, frequency and phase.

6. Audio decoder for generating a first audio output channel and a second audio output channel in response to a parametric audio representation including a set of signal parameters and a spatial image parameter, the decoder comprising:

a parameter processing unit configured to generate a first set of parameters and a second set of parameters based on the set of signal parameters, wherein the parameter processing unit is configured to generate a difference between the first sets of parameters and the second sets of parameters based on the spatial image parameter;

a first signal synthesizer configured to generate the first audio output channel according to the first set of parameters;

a second signal synthesizer configured to generate the second audio output channel according to the second set of parameters; and a value generator including at least one of: a low frequency oscillator and a random number generator, wherein the parameter processing unit introduces a difference between the first set of parameters and the second set of parameters based on a value received from the value generator.

7. The audio decoder according to claim 1, wherein the parameter processing unit performs a first up-mixing based on the at least one signal parameter of the set of signal parameters to form a first intermediate stereo set of parameters, and a second up-mixing based on the delayed version of the at least one signal parameter to form a second intermediate set of stereo parameters, and wherein the first intermediate set and the second intermediate set of stereo parameters are combined to form the first set of parameters and the second set of parameters.

8. The audio decoder according to claim 1, wherein the delay unit is further configured to provide a variable delay.

9. The audio decoder according to claim 8, wherein the variable delay is a function of at least one parameter component in one of the first set of parameters and the second set of parameters.

10. The audio decoder according to claim 4, wherein the parameter processing unit is further configured to alter at least one of: amplitude, frequency and phase, of at least one sinusoidal component of one of the first set of parameters and the second set of parameters according to the spatial image parameter.

11. The audio decoder according to claim 4, the parameter processing unit is further configured to apply at least one of: a gain to an amplitude, a shift to a phase, and a shift to a frequency of a sinusoidal component of the first set of parameters and the second set of parameters.

12. The audio decoder according to claim 4, further including a transient synthesizer and a noise synthesizer configured to generate respective transient and noise signals based on respective transient and noise parameters the parametric audio representation, and wherein the transient and noise signals are combined with the first audio output channel and the second audio output channel.

13. The audio decoder according to claim 12, further including a gain calculation unit configured to apply different gains to the transient signals so as to generate different first and second transient signal portions to be applied to the respective first audio output channel and the second audio output channel.

14. The audio decoder according to claim 12, further including a gain calculation unit to apply different gains to the noise signal so as to generate different first and second noise signal portions to be applied to the respective first audio output channel and the second audio output channel.

15. An audio decoder for generating a first audio output channel and a second audio output channel in response to a parametric audio representation including a set of signal parameters and a spatial image parameter, the decoder comprising:

a parameter processing unit configured to generate a first set of sinusoidal parameters and a second set of sinusoidal parameters based on the set of signal parameters, wherein the parameter processing unit is configured to generate a difference between the first sets of sinusoidal parameters and the second sets of sinusoidal parameters based on the spatial image parameter;

a first sinusoidal signal synthesizer configured to generate the first audio output channel according to the first set of sinusoidal parameters;

a second sinusoidal signal synthesizer configured to generate the second audio output channel according to the second set of sinusoidal parameters;

a transient synthesizer and a noise synthesizer configured to generate respective transient and noise signals based on respective transient and noise parameters the parametric audio representation, and wherein the transient and noise signals are combined with the first audio output channel and the second audio output channel; and a further noise synthesizer configured to generate a further noise signal based on the noise parameter in the parametric audio representation, wherein the further noise synthesizer is further configured to generate the noise signal essentially uncorrelated with the noise signal generated by the noise synthesizer, and wherein the noise signal and the further noise signal are mixed to form first and second noise signal portions to be applied to the respective first audio output channel and the second audio output channel.

16. An audio decoder for generating a first audio output channel and a second audio output channel in response to a parametric audio representation including a set of signal parameters and a spatial image parameter, the decoder comprising:

a parameter processing unit configured to generate a first set of sinusoidal parameters and a second set of sinusoidal parameters based on the set of signal parameters, wherein the parameter processing unit is configured to generate a difference between the first sets of sinusoidal parameters and the second sets of sinusoidal parameters based on the spatial image parameter;

a first sinusoidal signal synthesizer configured to generate the first audio output channel according to the first set of sinusoidal parameters;

a second sinusoidal signal synthesizer configured to generate the second audio output channel according to the second set of sinusoidal parameters;

a transient synthesizer and a noise synthesizer configured to generate respective transient and noise signals based on respective transient and noise parameters the parametric audio representation, and wherein the transient and noise signals are combined with the first audio output channel and the second audio output channel; and a low-frequent noise generator configured to generate low-frequent noise, wherein the noise signal generated by the noise synthesizer is multiplied with the low-frequent noise to generate a further noise signal essentially uncorrelated with the noise signal generated by the noise synthesizer, and wherein the signal and further noise signal are mixed to form first and second noise signal portions to be applied to the respective first audio output channel and the second audio output channel.

17. The audio decoder according to claim 1, wherein the audio decoder is configured to update the first set of parameters and the second set of parameters for each frame of the parametric audio representation.

18. A method of generating a first audio output channel and a second audio output channel in response to a parametric audio representation including a set of signal parameters and a spatial image parameter, the method comprising the acts of:

generating by parameter processing unit a first set of parameters and a second set of parameters based on the set of signal parameters, wherein a difference between the first set of parameters and the second sets of parameters is generated based on the spatial image parameter;

generating the first audio output channel by synthesizing the first set of parameters, generating the second audio output channel by synthesizing the second set of parameters; and generating a delayed version of at least one signal parameter of the set of signal parameters by a delay unit, wherein the parameter processing unit generates the first set of parameters and the second set of parameters based on the at least one signal parameter of the set of signal parameters and the delayed version of the at least one signal parameter.

19. The Method according to claim 18, wherein the first set of parameters and the second set of parameters include sinusoidal parameters, and wherein the synthesizing of the first set of parameters and the second set of parameters includes sinusoidal synthesis.

20. A non-transitory computer readable medium embodying comprising computer instructions which, when executed by a processor, configure the processor to perform the acts of:

generating by parameter processing unit a first set of parameters and a second set of parameters based on the set of signal parameters, wherein a difference between the first set of parameters and the second sets of parameters is generated based on the spatial image parameter;

generating the first audio output channel by synthesizing the first set of parameters, generating the second audio output channel by synthesizing the second set of parameters; and generating a delayed version of at least one signal parameter of the set of signal parameters by a delay unit, wherein the parameter processing unit generates the first set of parameters and the second set of parameters based on the at least one signal parameter of the set of signal parameters and the delayed version of the at least one signal parameter.

* * * * *